US009172181B2

(12) United States Patent
Huang

(10) Patent No.: US 9,172,181 B2
(45) Date of Patent: Oct. 27, 2015

(54) COAXIAL CONNECTOR AND TOOL FOR DISCONNECTING THE COAXIAL CONNECTOR

(71) Applicant: Chung-Chuan Huang, Tainan (TW)

(72) Inventor: Chung-Chuan Huang, Tainan (TW)

( * ) Notice: Subject to any disclaimer, the term of this patent is extended or adjusted under 35 U.S.C. 154(b) by 0 days.

(21) Appl. No.: 14/461,634

(22) Filed: Aug. 18, 2014

(65) Prior Publication Data

US 2014/0352500 A1 Dec. 4, 2014

Related U.S. Application Data

(62) Division of application No. 13/682,895, filed on Nov. 21, 2012, now Pat. No. 8,944,837.

(51) Int. Cl.

| | |
|---|---|
| ***H01R 13/62*** | (2006.01) |
| ***H01R 13/625*** | (2006.01) |
| ***H01R 43/26*** | (2006.01) |
| ***B25B 13/06*** | (2006.01) |
| *H01R 103/00* | (2006.01) |
| *H01R 24/40* | (2011.01) |

(52) U.S. Cl.

CPC ..... *H01R 13/625* (2013.01); *B25B 13/065* (2013.01); *H01R 43/26* (2013.01); *H01R 24/40* (2013.01); *H01R 2103/00* (2013.01)

(58) Field of Classification Search

CPC .... B25B 13/065; B25B 13/48; B25B 13/481; H01R 13/62933; H01R 13/623; H01R 13/622; H01R 13/625; H01R 13/62; H01R 2103/00

USPC ..... 81/121.1, 124.2, DIG. 8; 439/310–314, 439/316, 318, 332–333, 578

See application file for complete search history.

(56) References Cited

U.S. PATENT DOCUMENTS

| | | | | |
|---|---|---|---|---|
| 7,181,999 | B1 * | 2/2007 | Skeels et al. | 81/124.2 |
| 7,553,177 | B2 * | 6/2009 | Antonini et al. | 439/314 |
| 8,608,507 | B2 * | 12/2013 | Van Swearingen et al. | 439/578 |
| 8,794,111 | B2 * | 8/2014 | Wang | 81/124.2 |
| 8,944,837 | B2 * | 2/2015 | Huang | 439/314 |

* cited by examiner

*Primary Examiner* — Thanh Tam Le

(74) *Attorney, Agent, or Firm* — Rosenberg, Klein & Lee

(57) ABSTRACT

A coaxial connector includes a lip portion on one end thereof and an extension section coaxially extends from the lip portion. The extension section has a tubular portion coaxially mounted thereto and at least one protrusion extends from the outer surface of the tubular portion. A tool for disconnecting and connecting the coaxial connector includes a mounting portion for being mounted to the coaxial connector and the mounting portion has a yield slot defined therein which is located corresponding to the at least one protrusion of the coaxial connector.

5 Claims, 11 Drawing Sheets

COAXIAL CONNECTOR AND TOOL FOR DISCONNECTING THE COAXIAL CONNECTOR

RELATED APPLICATIONS

This application is a Divisional patent application of prior application Ser. No. 13/682,895, filed on Nov. 21, 2012, now pending. The entire disclosure of the prior application, Ser. No. 13/682,895 is considered a part of the disclosure of the accompanying Divisional application and is hereby incorporated by reference.

FIELD OF THE INVENTION

The present invention relates to a coaxial connector and a tool for disconnecting and connecting the coaxial connector.

BACKGROUND OF THE INVENTION

The coaxial connector is used to connect between electric or electronic parts, and the coaxial connector is easily manufactured, maintained and replaced. The conventional coaxial connector is widely used for connection between electronic parts of video and audio equipments, wide-band internet facilities, broadcasting equipments and communication equipments. The electronic parts are made smaller and lighter by the latest technology so that the reception holes for the coaxial connector are reduced. Therefore, the connection and dis-connection between the coaxial connector and the coaxial cable take longer time and require skill.

FIGS. 1 and 2 show the conventional coaxial connector 10 and the conventional tool 20 for disconnecting and connecting the coaxial connector 10. The coaxial connector 10 comprises a connection portion 101 and an extension section 102 extends from the connection portion 101. A J-shaped slot 103 is defined in the connection portion 101 and the extension section 102. The outer diameter of the extension section 102 is smaller than that of the connection portion 101. A lip portion 104 is coaxially connected to the extension section 102 and has the same outer diameter as the connection portion 101. Multiple grooves 1041 are defined in the outer surface of the lip portion 104 and two slots 1042 are symmetrically defined in the outer surface of the lip portion 104. The depth and width of the slots 1042 are larger than those of the grooves 1041. The tool 20 has a mounting portion 201 which is suitable for being mounted to the coaxial connector 10. The mounting portion 201 has a rib 202 protruding from the inner periphery thereof so as to be engaged with the slot 1042. The reception hole of an electronic part has a plug 30 which has a block 301 which is engaged with the j-shaped slot 103 by rotating the tool 20.

The strength of the lip portion 104 becomes weak because the multiple grooves 1041 and the slot 1042, so that the lip portion 104 tends to be broken by impacts. Besides, the depth of the slot 1042 is limited so that when the rib 202 drives the wall of the slot 1042, the wall of the slot 1042 is easily damaged and the rib 202 is difficult to be disengaged from the slot 1042. Furthermore, there is no proper mechanism to position the connection between the coaxial connector 10 which is then easily shifted or loosened. The slots 1042 are tiny and the assemblers have to carefully aim and identify the slots 1042 and this takes a lot of time.

The present invention intends to provide a coaxial connector and a tool for disconnecting the coaxial connector, both of which improve the shortcomings of the conventional coaxial connector and the conventional tool.

SUMMARY OF THE INVENTION

The present invention relates to a coaxial connector and comprises a lip portion on one end of the coaxial connector and an extension section coaxially extends from the lip portion. The extension section has a tubular portion coaxially mounted thereto and at least one protrusion extends from the outer surface of the tubular portion.

Preferably, the lip portion has at least one recess defined axially therein and the extension section has a guide slot defined therein. The guide slot is located corresponding to the at least one recess and has an engaging portion formed therein.

Preferably, the outer diameter of the extension section is smaller than that of the lip portion.

Preferably, the top of the at least one protrusion is located corresponding to the outer diameter of the lip portion.

Preferably, the outer surface of the tubular portion has multiple grooves defined therein.

Preferably, the outer surface of the tubular portion has two protrusions extending therefrom and the two protrusions are located symmetrically to each other.

The present invention provides a tool for disconnecting a coaxial connector and comprises a mounting portion which has a yield slot defined therein. The yield slot is located corresponding to the at least one protrusion of the coaxial connector.

Preferably, the coaxial connector has a lip portion from an end thereof, the mounting portion is in contact with the lip portion of the coaxial connector when the yield slot of the tool accommodates the at least one protrusion of the coaxial connector.

Preferably, the yield slot is defined in the inner periphery of the mounting portion.

Preferably, the yield slot is defined through the wall of the mounting portion.

The tool is easily aim the yield slot to the protrusion of the coaxial connector so as to rotate the coaxial connector to engage the plug with the engaging portion of the guide slot. When the yield slot is engaged with the protrusion, the mounting portion of the tool is in contact with the lip of the coaxial connector so as to position the coaxial connector. Accordingly, the coaxial connector can be easily from the smaller electronic part. Furthermore, the top of the protrusion is located corresponding to the outer diameter of the lip portion so that the coaxial connector has better strength and is not broken by impact. The protrusion also has better strength can bear shear force applied by the tool and the protrusion also makes the aiming easier when assembling.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
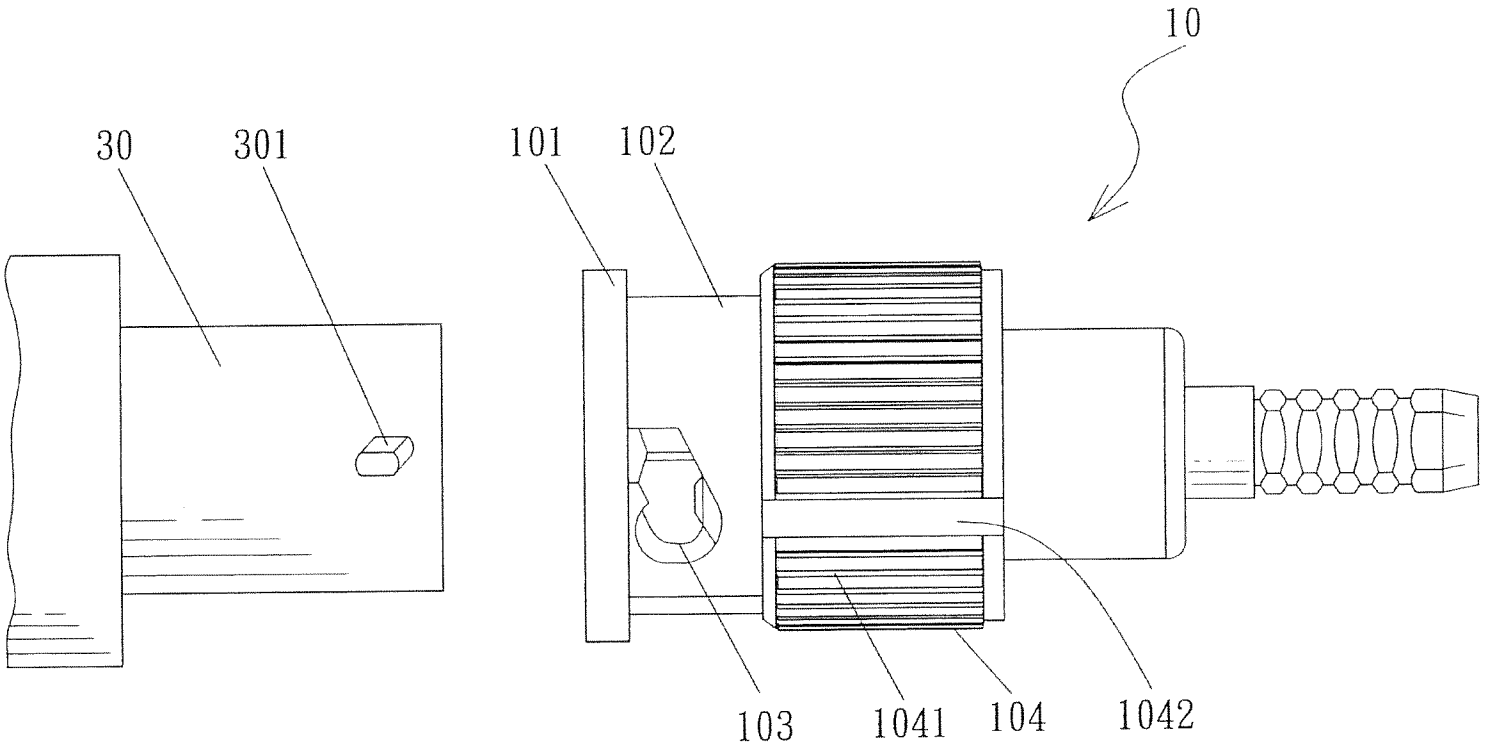
FIG. 1 PRIOR ART
FIG. 1 shows the conventional coaxial connector and a plug of a cable.
Figure 2:
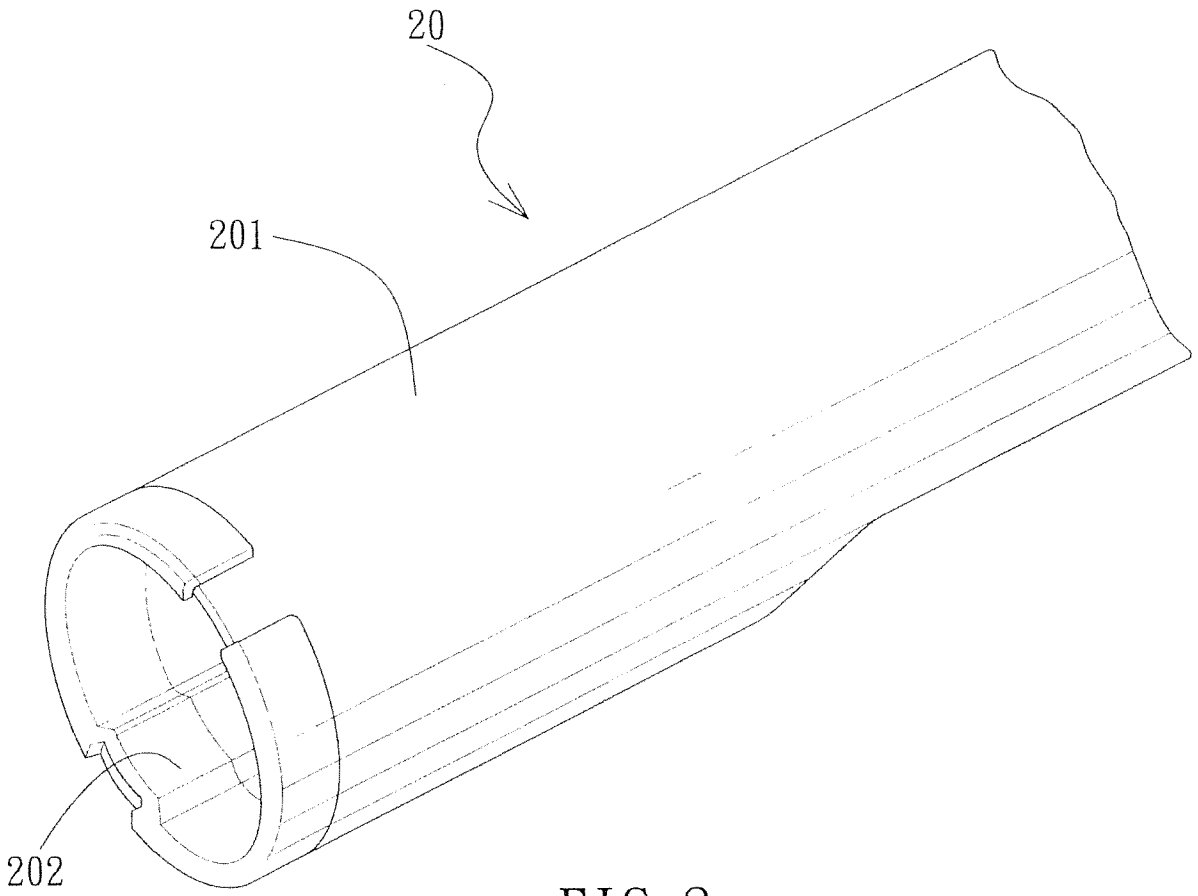
FIG. 2 PRIOR ART
FIG. 2 is a perspective view to show the conventional tool.

Referring to FIGS. 3 to 8, the coaxial connector 1 of the present invention comprises a lip portion 11 on an end of the coaxial connector 1 and an extension section 12 coaxially extends from the lip portion 11. The outer diameter of the extension section 12 is smaller than that of the lip portion 11. The extension section 12 has a tubular portion 13 coaxially mounted thereto and at least one protrusion 131 extends from the outer surface of the tubular portion 13. The outer surface of the tubular portion 13 has multiple grooves 132 defined therein. In this embodiment, there are two protrusions 131 on the tubular portion 13 and the two protrusions 131 are located symmetrically to each other to ensure that the coaxial connector 1 to be rotatable stably. The top of each of the protrusions 131 is located corresponding to the outer diameter of the lip portion 11. The lip portion 11 has at least one recess 111 defined axially therein and the extension section 12 has a guide slot 121 defined therein. The guide slot 121 is located corresponding to the at least one recess 111 and has an engaging portion 122 formed therein.

The tool 2 for disconnecting and connecting a coaxial connector 1 of the present invention comprises a mounting portion 21 which has two yield slots 211 defined therein and the yield slots 211 are located corresponding to the protrusions 131 of the coaxial connector 1. The mounting portion 21 is in contact with the lip portion 11 of the coaxial connector 1 when the yield slots 211 of the tool 2 accommodate the protrusions 131. The yield slots 211 are defined in the inner periphery of the mounting portion 21.

Figure 3:
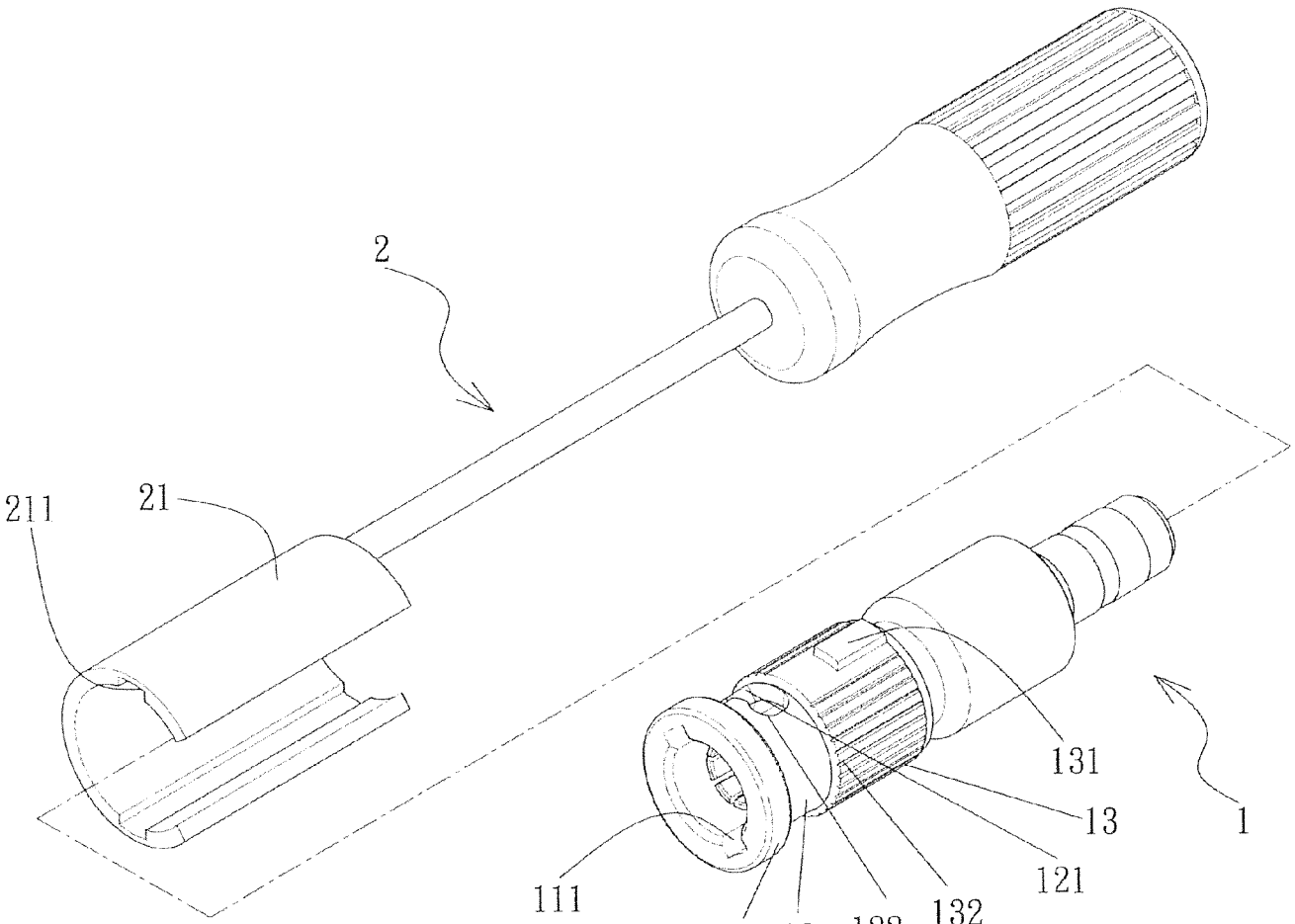
FIG. 3 is an exploded view to show the coaxial connector and the tool of the present invention.
Figure 4:
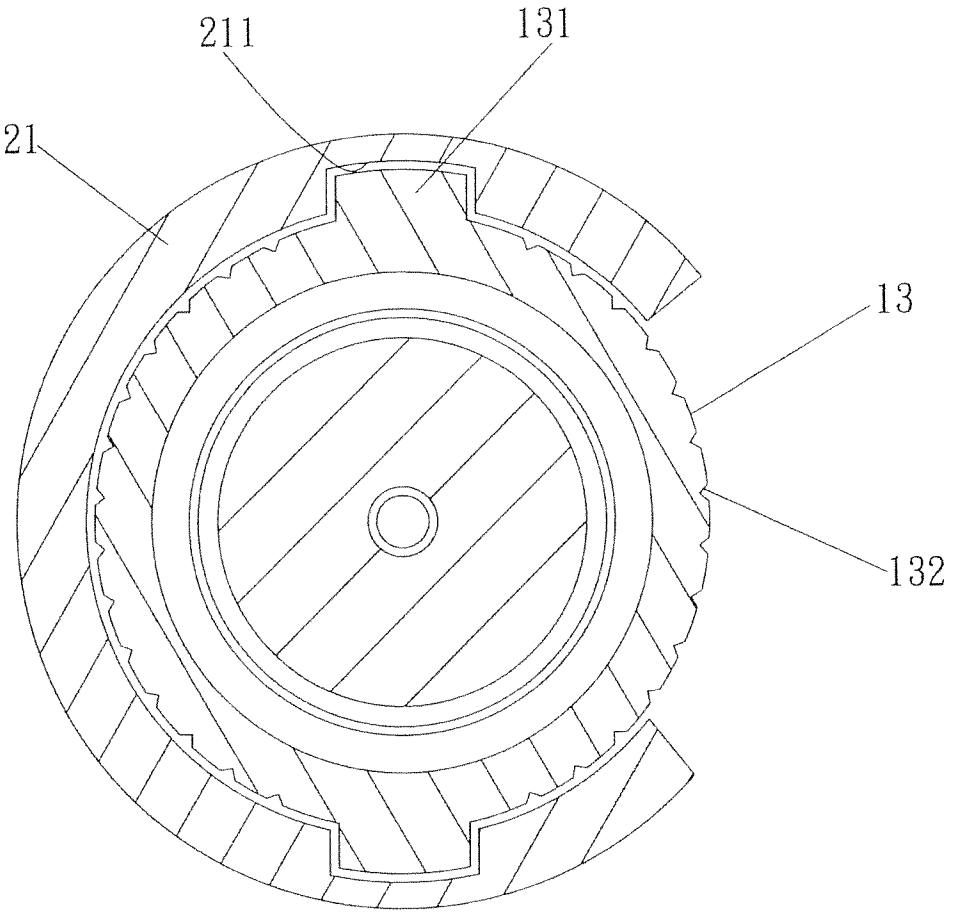
FIG. 4 is an end cross sectional view of the engagement between the coaxial connector and the tool of the present invention.
Figure 5:
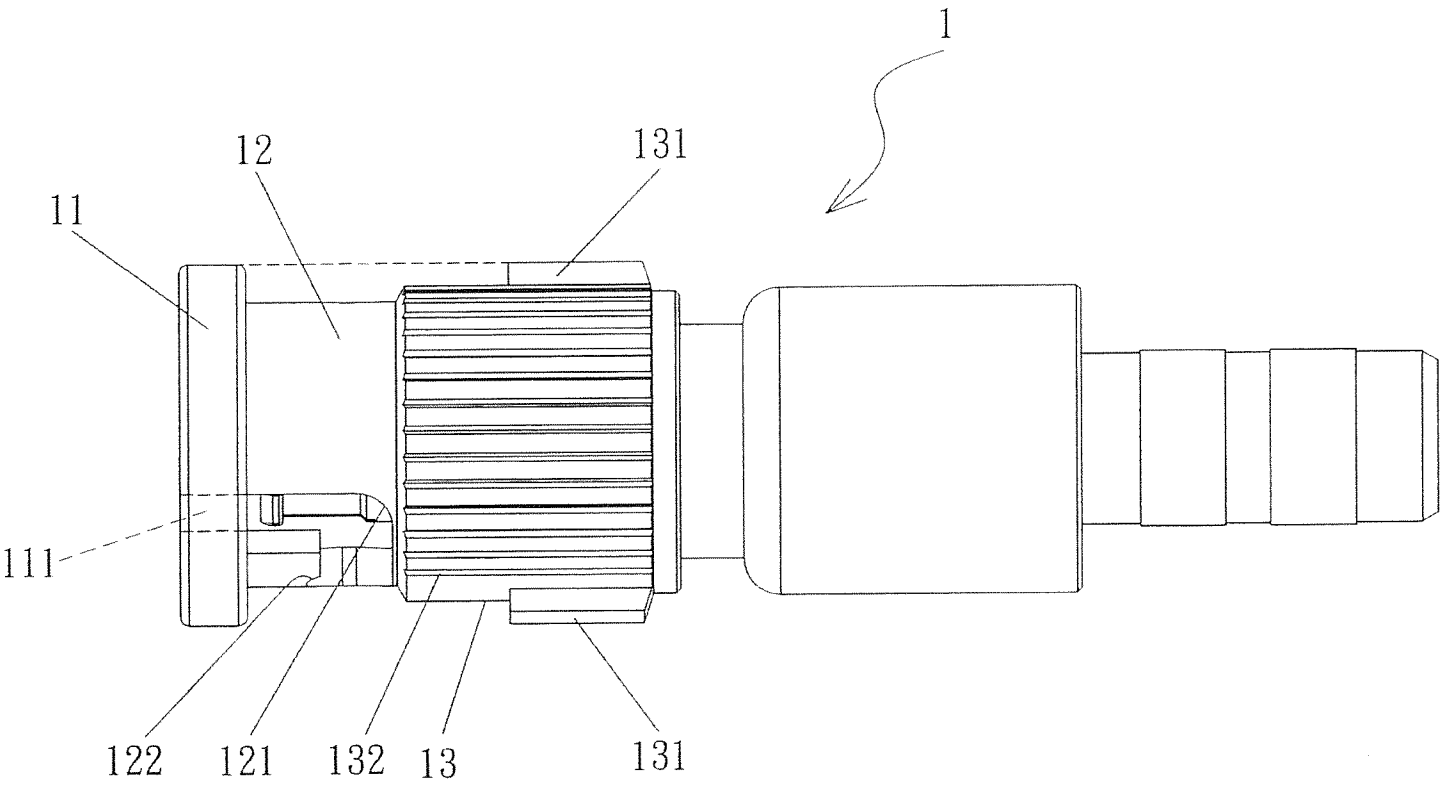
FIG. 5 is a plan view of the coaxial connector of the present invention.

The groves 132 of the tubular portion 13 provide sufficient friction when the user grabs the coaxial connector 1. The receptacle hole of the cable is slightly larger than the outer diameter of the coaxial connector 1 and the depth of the receptacle hole is almost the same as the length of the coaxial connector 1, so that the coaxial connector 1 needs a tool 2 to pick in an electronic equipment with very limited space. As shown in FIGS. 3 and 4, when removing the coaxial connector 1 from the receptacle hole, the yield slots 211 of the tool 2 are engaged with the protrusions 131 which are visible and easily identified. The tool 2 is then rotated to be separated the coaxial connector 1 from the plug. The tops of the protrusions 131 are correspondent to the outer diameter of the lip portion 11 so that the tubular portion 13 does not need to be further machined. The coaxial connector 1 has better strength and is not broken by impact. The protrusions 131 also have better strength to bear shear force applied by the tool 2 when the protrusions 131 are engaged with the yield slots 211.

Figure 6:
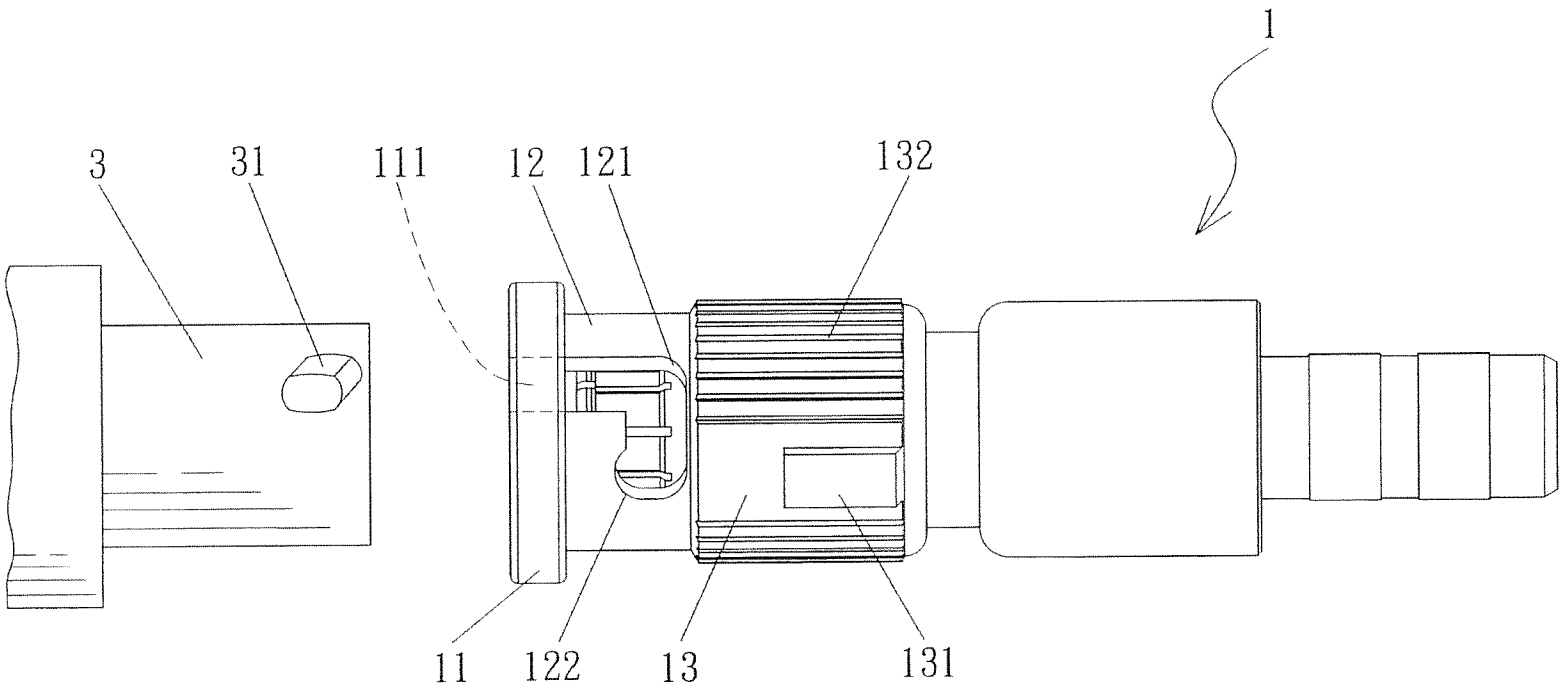
FIG. 6 shows the coaxial connector of the present invention and a plug of a cable.
Figure 7:
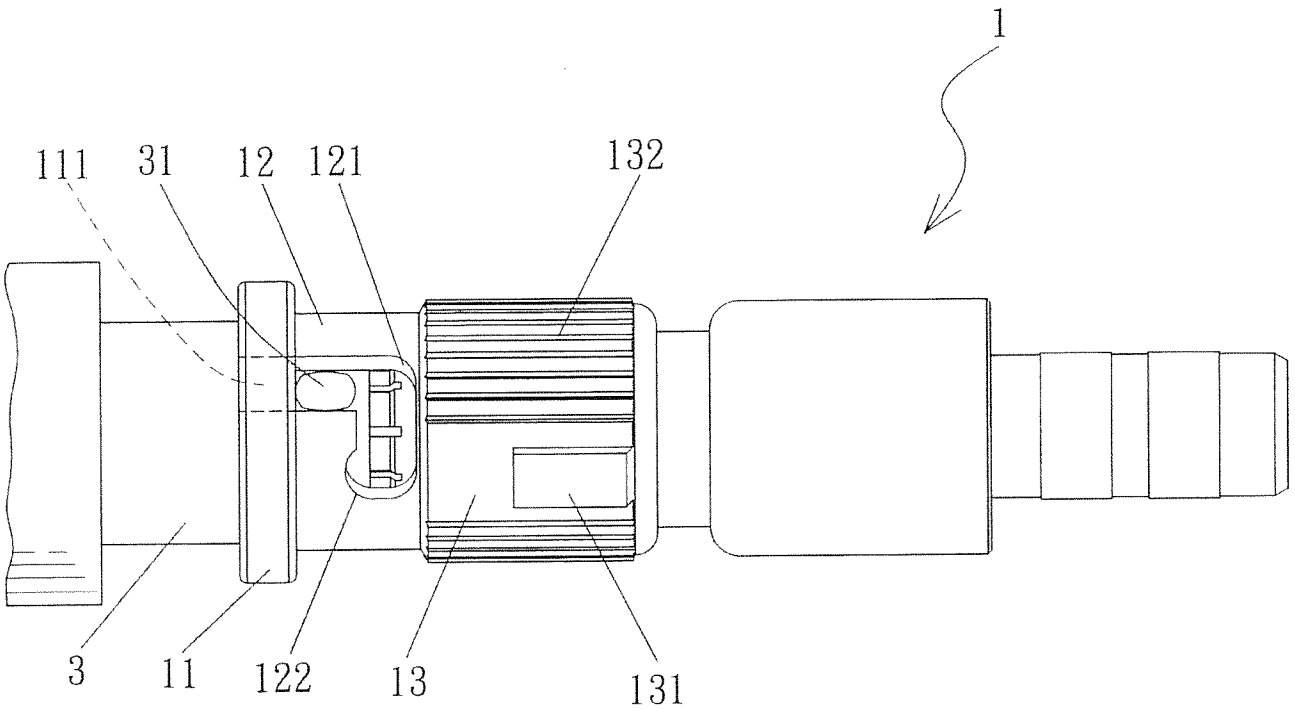
FIG. 7 shows that the block on the plug is engaged with the guide slot of the coaxial connector of the present invention.
Figure 8:
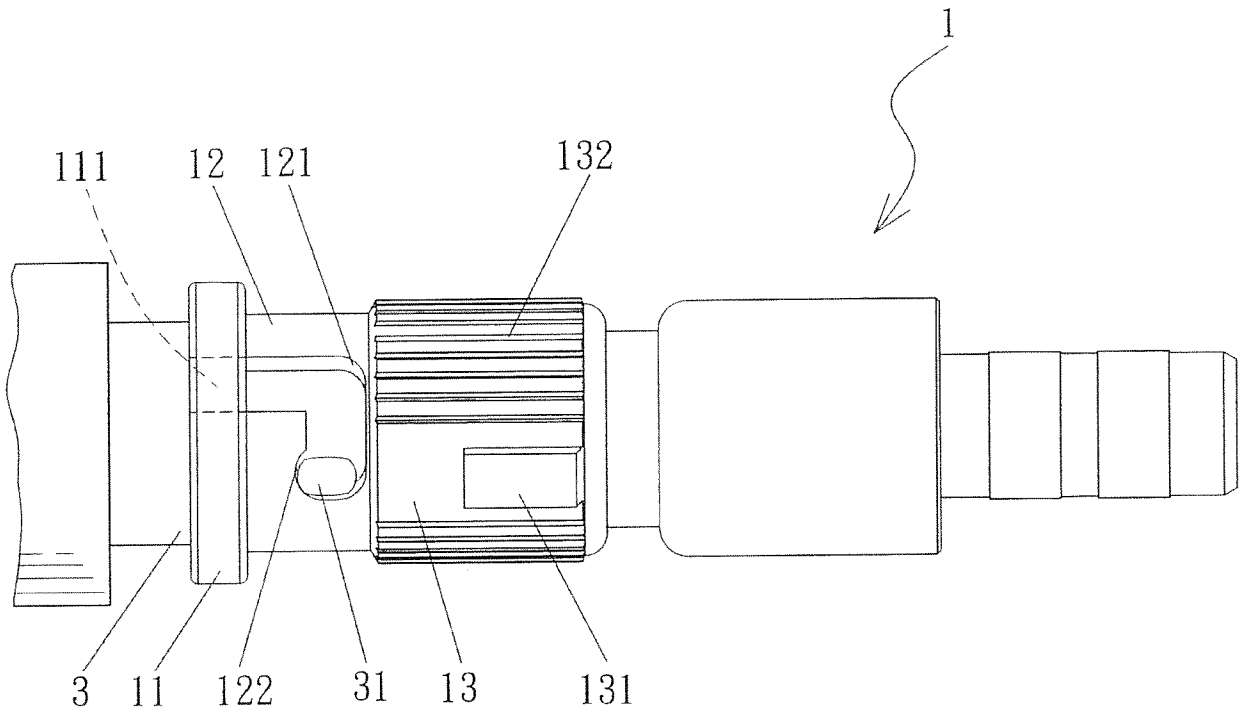
FIG. 8 shows that the block on the plug reaches the engaging portion of the guide slot of the coaxial connector of the present invention.

As shown in FIG. 6, the plug 3 of a coaxial cable has a block 31 extending therefrom and the block 31 is located corresponding to the recess 111, so that the plug 3 is inserted into the coaxial connector 1 and the block 31 is located in the recess 111. The outer diameter of the extension section 12 is smaller than the outer diameter of the lip portion 11, so that the block 31 moves along the guide slot 121 as shown in FIG. 7. When the block 31 reaches the engaging portion 122 of the guide slot 121 as shown in FIG. 8, the plug 3 is connected with the coaxial connector 1. When the plug 3 is to be separated from the coaxial connector 1, simply rotating the coaxial connector 1, the block 31 is removed from the guide slot 121.

Figure 9:
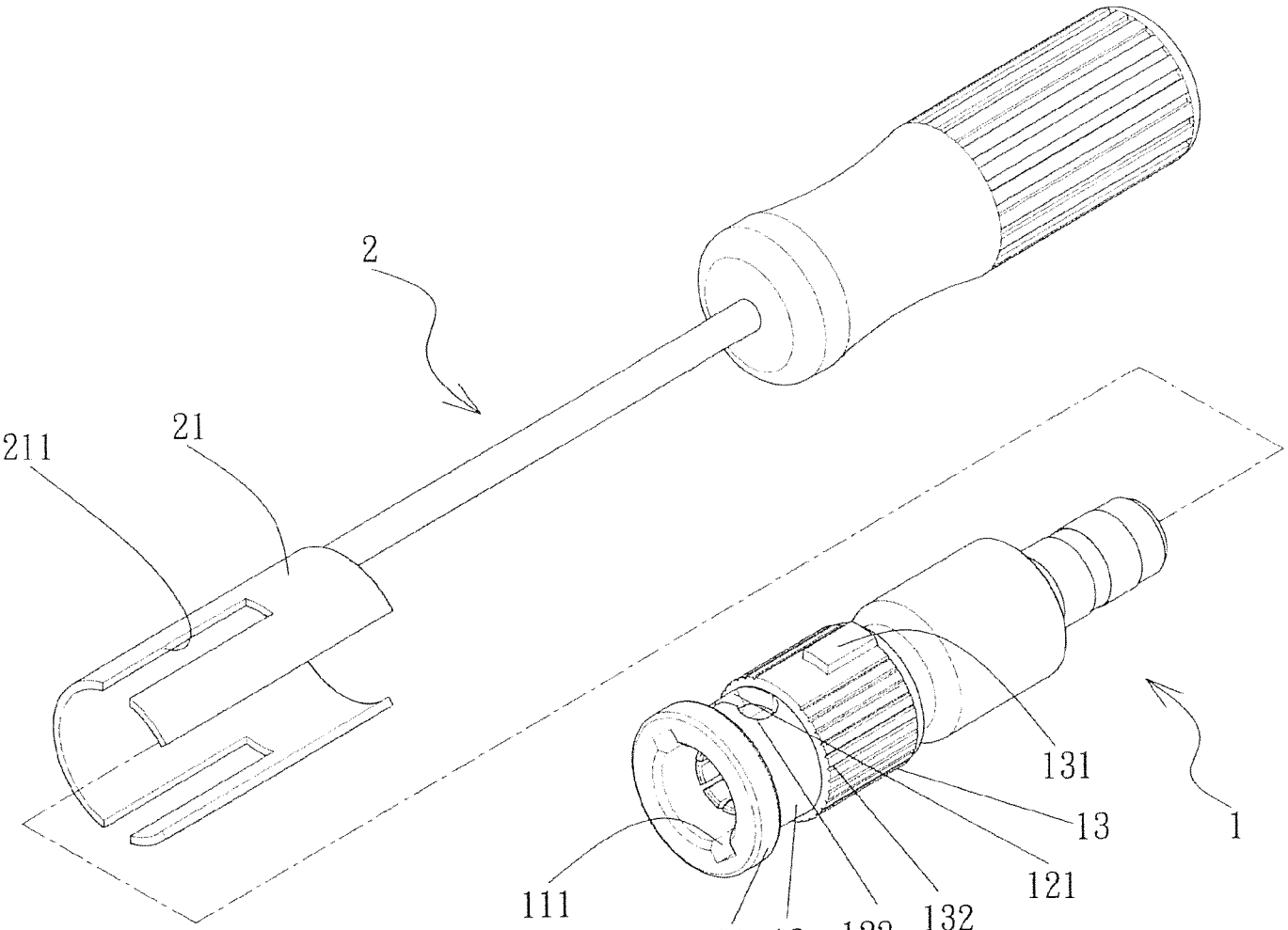
FIG. 9 is an exploded view to show the coaxial connector and the second embodiment of the tool of the present invention.
Figure 10:
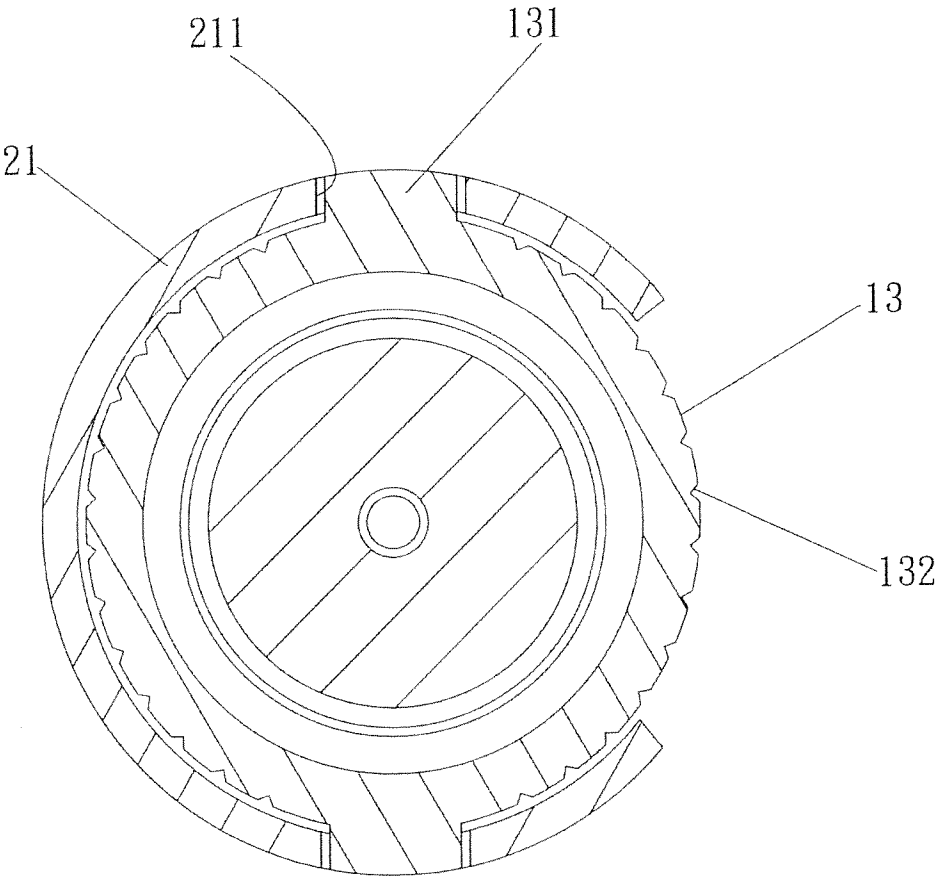
FIG. 10 is an end cross sectional view of the engagement between the coaxial connector and the second embodiment of the tool of the present invention.
Figure 11:
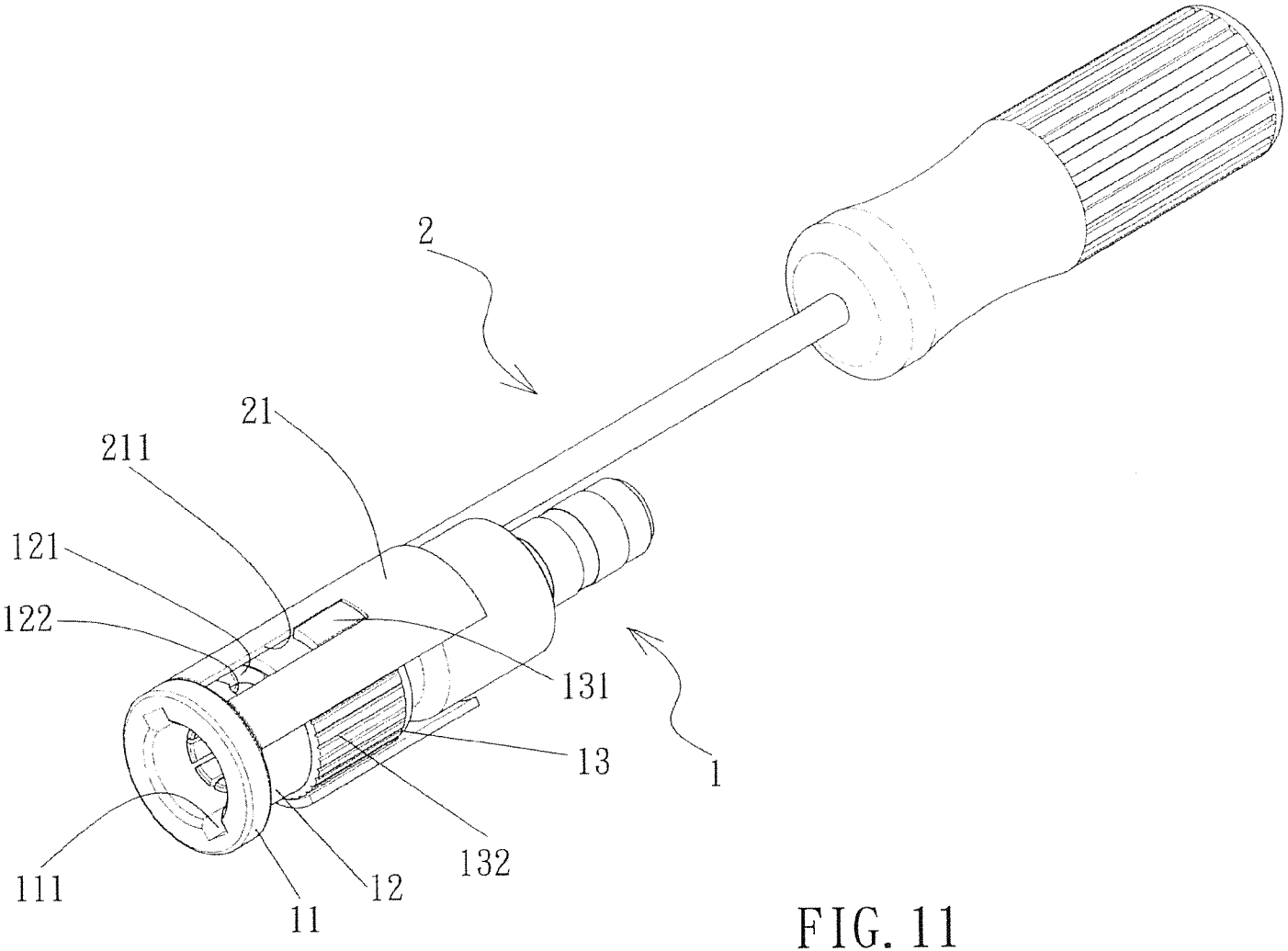
FIG. 11 shows that the second embodiment of the tool is mounted to the coaxial connector of the present invention.

FIGS. 9 to 11 show the second embodiment of the tool 2, the difference from the first embodiment is that the yield slots 211 are defined through the wall of the mounting portion 21 so that the user is more easily to engage the protrusions 131 with the yield slots 211. As shown in FIG. 11, the distal end of the mounting portion 21 is in contact with the lip portion 11 when the protrusions 131 are engaged with the yield slots 211.

The protrusions 131 are visible and easily identified so that user can easily engage the protrusions 131 with the yield slots 211 in an electronic equipment with very limited space. This increases the efficiency of the assembling actions.

The tops of the protrusions 131 are correspondent to the outer diameter of the lip portion 11 so as to reinforce the strength of the coaxial connector 1 such that the coaxial connector 1 has better strength and is not broken by impact. The protrusions 131 also have better strength can bear shear force applied by the tool 2 when the protrusions 131 are engaged with the yield slots 211.

The yield slots 211 are defined through the wall of the mounting portion 21 so that the user is more easily to identify the protrusions 131 and to engage the protrusions 131 with the yield slots 211. The distal end of the mounting portion 21 is in contact with the lip portion 11 when the protrusions 131 are engaged with the yield slots 211. Therefore, the tool 2 and the coaxial connector 1 are well positioned during assembling and disassembling.

While we have shown and described the embodiment in accordance with the present invention, it should be clear to those skilled in the art that further embodiments may be made without departing from the scope of the present invention.

What is claimed is:

1. A tool for disconnecting and connecting a coaxial connector having at least one protrusion extending radially from an outer surface thereof, and a lip portion extending radially from an axial end thereof, the tool comprising:

a mounting portion having a wall surface extending cylindrically between two edges spaced by a longitudinal slit, the wall surface having at least one yield slot defined therein, the yield slot radially receiving to retentively capture the at least one protrusion of the coaxial connector therein.

2. The tool as claimed in claim 1, wherein the mounting portion is in contact with the lip portion of the coaxial connector when the yield slot of the tool receives the at least one protrusion.

3. The tool as claimed in claim 1, wherein the yield slot is defined in an inner periphery of the mounting portion.

4. A tool for disconnecting and connecting a coaxial connector having at least one protrusion extending radially from an outer surface thereof, and a lip portion extending radially from an axial end thereof, the tool comprising:

a mounting portion having a wall surface extending cylindrically between two edges spaced by a longitudinal slit, a yield slot being defined through the wall surface, the yield slot radially receiving to retentively capture the at least one protrusion of the coaxial connector therein.

5. The tool as claimed in claim 4, wherein the mounting portion is in contact with the lip portion of the coaxial connector when the yield slot of the tool receives the at least one protrusion.

* * * * *